US009038647B1

(12) United States Patent
Scott

(10) Patent No.: US 9,038,647 B1
(45) Date of Patent: May 26, 2015

(54) WALKING CANE

(76) Inventor: Ella M. Scott, Mesquite, TX (US)

( * ) Notice: Subject to any disclaimer, the term of this patent is extended or adjusted under 35 U.S.C. 154(b) by 366 days.

(21) Appl. No.: 13/411,889

(22) Filed: Mar. 5, 2012

Related U.S. Application Data

(60) Provisional application No. 61/449,130, filed on Mar. 4, 2011.

(51) Int. Cl.
*A61H 3/00* (2006.01)
*A61H 3/02* (2006.01)

(52) U.S. Cl.
CPC .. *A61H 3/00* (2013.01); *A61H 3/02* (2013.01); *A61H 2003/0272* (2013.01); *A61H 2003/006* (2013.01)

(58) Field of Classification Search
CPC ..... A61H 2003/006; A61H 2003/0272; A61H 2003/0205; A45B 1/00; A45B 5/00
USPC ..... 135/65, 66, 69, 70, 75
See application file for complete search history.

(56) References Cited

U.S. PATENT DOCUMENTS

| | | | | |
|---|---|---|---|---|
| 952,335 | A * | 3/1910 | Killian | 248/155.1 |
| 3,999,565 | A | 12/1976 | Delacour et al. | |
| 5,410,835 | A | 5/1995 | Vetter | |
| 7,344,320 | B2 | 3/2008 | Barker et al. | |
| 7,377,662 | B1 * | 5/2008 | Bernstein et al. | 362/102 |
| 2004/0040591 | A1 * | 3/2004 | Ma | 135/908 |
| 2008/0083442 | A1 * | 4/2008 | Sherman | 135/65 |
| 2008/0128009 | A1 * | 6/2008 | Blake | 135/75 |
| 2011/0100404 | A1 * | 5/2011 | La Chimia | 135/77 |
| 2012/0042918 | A1 * | 2/2012 | Tessier | 135/67 |
| 2013/0199586 | A1 * | 8/2013 | Van Den Driesche | 135/69 |

* cited by examiner

*Primary Examiner* — David R Dunn
*Assistant Examiner* — Danielle Jackson
(74) *Attorney, Agent, or Firm* — Kenneth L. Tolar

(57) ABSTRACT

A cane includes an elongated shaft having an upper end and a lower end. The shaft is formed of at least two telescoping, adjustable sections that allow the height of the shaft to be selectively varied. Near the upper end of the shaft is a motorized armrest that can be raised to a horizontal position to support a user's arm or elbow. Slidably mounted on a lower portion of the shaft is a deployable leg assembly for firmly bracing the cane when a user leans on the armrest. Accordingly, if a user wishes to rest, he or she deploys the leg assembly and raises the armrest allowing the cane to easily support the user's body weight. When the armrest and leg assembly are collapsed, the cane may be used in a conventional fashion.

13 Claims, 2 Drawing Sheets

WALKING CANE

CROSS REFERENCE TO RELATED APPLICATIONS

This application is entitled to the benefit of provisional application No. 61/449,130 filed on Mar. 4, 2011.

BACKGROUND OF THE INVENTION

The present invention relates to a cane having a deployable leg assembly and an armrest that allow a user to safely lean on the cane when resting.

DESCRIPTION OF THE PRIOR ART

Many people who use a walking cane cannot stand for prolonged periods of time. However, a conventional cane will not adequately support a person who wishes to lean on the cane to reduce the load on the feet or back. Although a walker-type cane usually has four legs that can support a person's weight, it is bulky and more cumbersome to use. Accordingly, there is currently a need for a cane on which a user may safely lean when resting.

A review of the prior art reveals a few canes having auxiliary support structures for enhanced stabilization. For example, U.S. Pat. No. 3,999,565 issued to Delacour et al. discloses a cane having a plurality of deployable auxiliary legs attached thereto. The legs are pivotally attached to a collar that is slidably mounted on a central shaft. Hingedly attached to the collar is a knee brace that deploys the auxiliary legs when pressure is applied thereto.

U.S. Pat. No. 5,410,835 issued to Vetter discloses a firearm bipod having an armrest mounted thereon.

U.S. Pat. No. 7,344,320 issued to Barker et al. discloses a length-adjustable walking staff having a tripod base.

Although the patent to Delacour et al. discloses a cane having deployable auxiliary legs, the device is specifically designed to rest an injured knee or leg. Therefore, a user cannot safely lean against the cane to rest while standing. Furthermore, manually deploying the knee rest of Delacour is difficult, particularly for the elderly or infirm. Also, a patient's body weight can shift the outwardly-extending support legs, causing the patient to fall. Finally, conventional canes are not always readily visible, particularly in poorly-lit areas; as a result, passersby often collide with a cane or walker, increasing the likelihood of an accidental injury.

The present invention overcomes the disadvantages of the prior art by providing a cane having an armrest on which a user may lean when fatigued and deployable legs for supporting the user's body weight. The armrest is conveniently raised and lowered with a reversible motor that is controlled by an easily-accessible switch panel. Furthermore, the support legs include uniquely-configured feet that further stabilize the cane when subjected to the user's body weight. LED's and reflective tape on the legs enhance the cane's visibility in dark or poorly-lit areas.

SUMMARY OF THE INVENTION

The present invention relates to a cane comprising an elongated shaft having an upper end and a lower end. The shaft is formed of at least two telescoping, adjustable sections that allow the height of the shaft to be selectively varied. Near the upper end of the shaft is a motorized armrest that can be raised to a horizontal position to support a user's arm or elbow. Slidably mounted on a lower portion of the shaft is a deployable leg assembly for firmly bracing the cane when a user leans on the armrest. Accordingly, if a user wishes to rest, he or she deploys the leg assembly and raises the armrest allowing the cane to easily support the user's body weight. When the armrest and leg assembly are collapsed, the cane may be used in a conventional fashion.

It is therefore an object of the present invention to provide a cane that can safely support a user's body weight.

It is another object of the present invention to provide a cane having an armrest and deployable support legs for withstanding a user's body weight.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
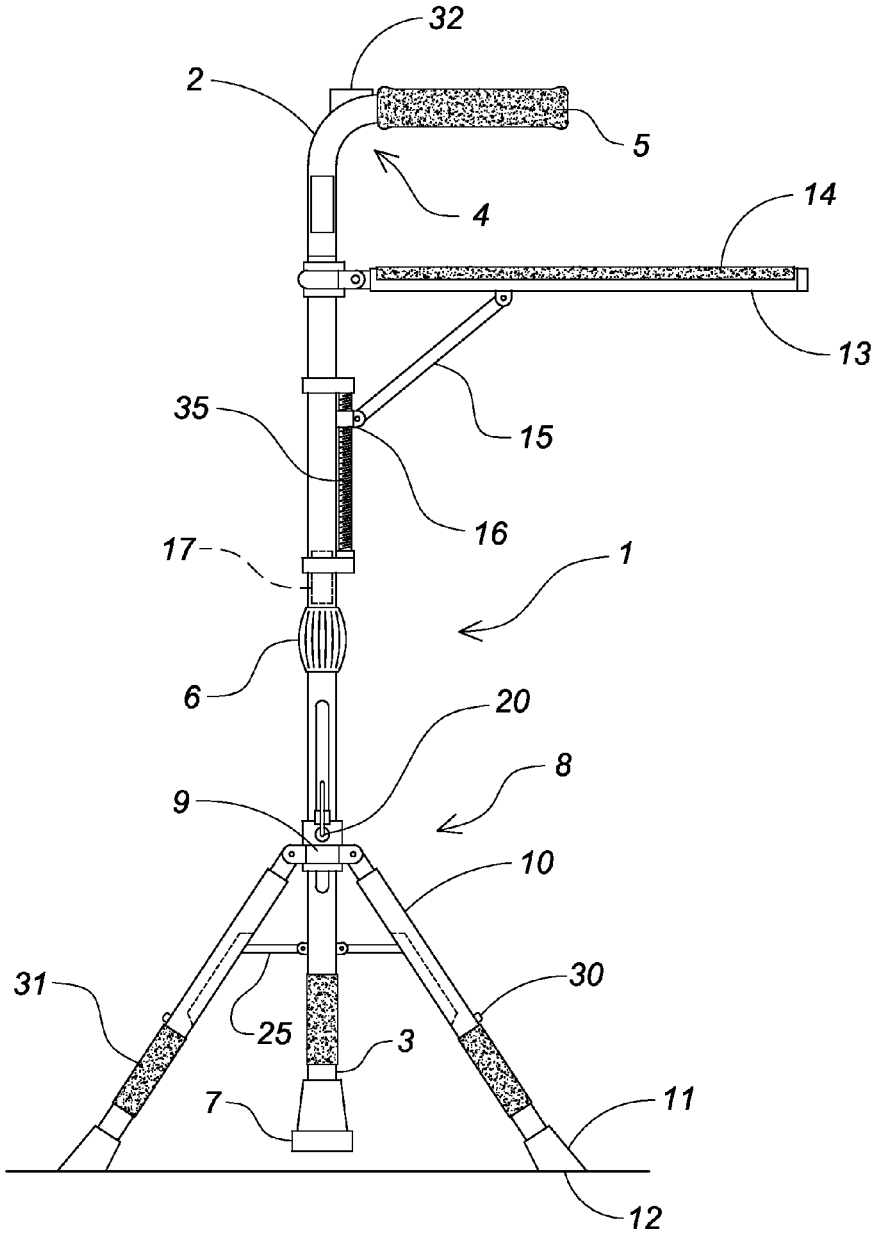
FIG. 1 is a plan view of the cane with the leg assembly and armrest in a deployed position.
Figure 2:
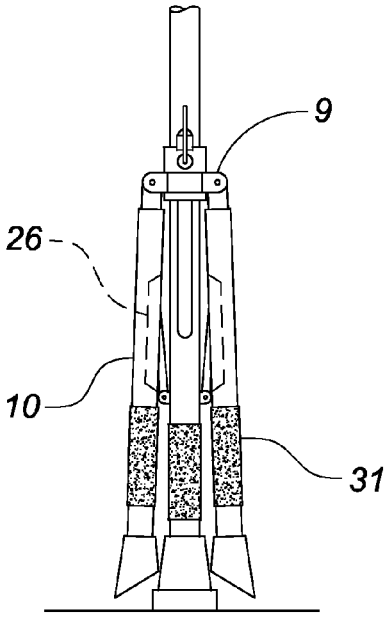
FIG. 2 depicts the leg assembly in a collapsed orientation.
Figure 4:
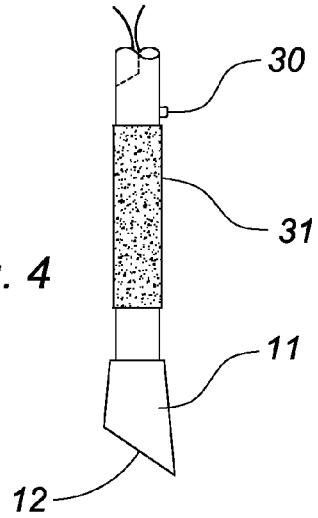
FIG. 4 is an isolated, sectional view of an exemplary support leg.
Figure 3:
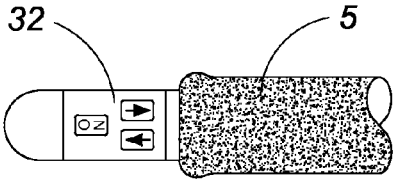
FIG. 3 is an isolated view of the handle and adjacent switch panel.

The present invention relates to a cane comprising an elongated shaft 1 having an upper end 2 and a lower end 3. At the upper end is an L-shaped handle 4 having at least a portion encapsulated by a foam sleeve 5. The shaft is formed of at least two telescoping sections that are adjustably connected with a compression fitting 6 for selectively varying the height of the shaft. On the lower end of the shaft is a foot 7 similar to that found on conventional canes. Slidably mounted on the shaft, above the foot, is a deployable leg 8 assembly for stabilizing the cane when subjected to a user's body weight as described in more detail below.

The leg assembly includes a collar 9 slidably mounted on the shaft having a spring-biased pin 20 attached thereto. The pin releasably fits within either of two holes on the shaft to secure the leg assembly in either a collapsed or a deployed position. Pivotally attached to the collar are a plurality of support legs 10, each having a foot 11 with an angled lower surface 12 that becomes substantially horizontal when the legs are fully deployed to flatly abut the underlying surface. Therefore, the feet firmly stabilize the support legs when subjected to a user's body weight to prevent slipping or shifting. Pivotal struts 25 guide the legs when the collar is raised or lowered and buttress the legs when the leg assembly is fully expanded. When the leg assembly is collapsed, the struts unobtrusively fit within storage slots 26 on the legs.

Proximal the handle is a pivotal armrest 13 on which a user can lean when resting. The armrest includes a padded upper surface 14 and a pivotal brace member 15 extending from a lower surface. A distal end of the brace is pivotally attached to a threaded annulus 16 that rides on a rotating bolt 35 mounted on the shaft. A reversible motor 17 rotates the bolt in either of two directions to translate the annulus along the bolt's longitudinal axis to raise or lower the armrest.

Pulsing LED's 30 and reflective tape 31 are positioned on an intermediate portion of each support leg to enhance the cane's visibility in dark or poorly-lit areas. The LED's and armrest motor are controlled with a switch panel 32 mounted on the handle 4.

Accordingly, if a user wishes to rest, he or she deploys the leg assembly and armrest, allowing the cane to easily support the user's body weight. When the armrest and leg assembly are collapsed, the cane may be used in a conventional fashion.

The above-described device is not limited to the exact details of construction and enumeration of parts provided herein. For example, the leg assembly preferably includes three support legs that form a tripod when deployed, though the number of legs, as well as the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An improved walking cane comprising:

an elongated shaft having an upper end and a lower end;

a pivotal armrest mounted on said shaft, proximal the upper end, on which a user leans to rest;

a deployable leg assembly slidably mounted on a lower portion of said shaft for firmly bracing said shaft when a user leans on said armrest;

a pivotal brace member extending from a lower surface of said armrest, a distal end of said brace member pivotally attached to a threaded annulus riding on a rotatable bolt mounted on said shaft; and a reversible motor operably connected to said bolt for rotating said bolt in either of two directions to axially translate the annulus to raise and lower said armrest.

2. The cane according to claim 1 wherein said leg assembly comprises:

a collar slidably mounted on said shaft;

a plurality of pivotal support legs radially extending from said collar.

3. The cane according to claim 2 further comprising reflective tape attached to the intermediate portion of each of said legs.

4. The cane according to claim 2 wherein each of said support legs includes pulsing LEDs mounted on an intermediate portion to visibly enhance said leg assembly.

5. The cane according to claim 4 further comprising a handle at an upper end of said shaft.

6. The cane according to claim 5 wherein said LEDs and said motor are controlled with a switch panel mounted on said handle.

7. The cane according to claim 5 wherein said handle is L-shaped and includes a foam sleeve thereon.

8. The cane according to claim 2 wherein each of said support legs includes a foot at a distal end, said foot having an angled lower surface that becomes substantially horizontal when the legs are fully deployed for flatly abutting an underlying surface to prevent shifting and slipping.

9. The cane according to claim 2 wherein said collar includes a spring-biased pin attached thereto, said pin releasably fitting within either of two holes on said shaft to secure the leg assembly in either a collapsed or a deployed position.

10. The cane according to claim 2 wherein said support legs each include a pivotal strut extending from said leg to said shaft to buttress the legs when the leg assembly is expanded, said struts unobtrusively folding into storage slots on said legs when the leg assembly is collapsed.

11. The cane according to claim 1 wherein said shaft is length adjustable.

12. The cane according to claim 1 wherein said shaft is formed of at least two telescoping sections adjustably connected with a compression fitting for selectively varying a height of said shaft.

13. The cane according to claim 1 wherein said armrest includes a padded upper surface.

* * * * *